US007333766B2

(12) United States Patent
Dutoit et al.

(10) Patent No.: US 7,333,766 B2
(45) Date of Patent: Feb. 19, 2008

(54) COLOUR PROOFER WITH CURL CONTROL MEANS

(75) Inventors: Erik Dutoit, Emblem (BE); Stefaan Deman, Roeselare (BE); Jozef Feys, Middelkerke (BE)

(73) Assignee: Agfa Graphics NV, Mortsel (BE)

( * ) Notice: Subject to any disclaimer, the term of this patent is extended or adjusted under 35 U.S.C. 154(b) by 283 days.

(21) Appl. No.: 11/114,622

(22) Filed: Apr. 26, 2005

(65) Prior Publication Data

US 2005/0242496 A1 Nov. 3, 2005

Related U.S. Application Data

(60) Provisional application No. 60/576,921, filed on Jun. 4, 2004.

(30) Foreign Application Priority Data

Apr. 30, 2004 (EP) ..... 04101862

(51) Int. Cl.
*G03G 15/00* (2006.01)
*B65H 29/00* (2006.01)
*B65H 29/52* (2006.01)

(52) U.S. Cl. ..... 399/406; 400/578; 400/613.3; 271/278; 271/306

(58) Field of Classification Search ..... None
See application file for complete search history.

(56) References Cited

U.S. PATENT DOCUMENTS 3,735,937 A 5/1973 Plantard
3,881,720 A * 5/1975 Benzing ..... 271/278
5,566,906 A 10/1996 Kamada et al.
5,884,860 A 3/1999 Ishikawa et al.
6,654,573 B2 * 11/2003 Carlson et al. ..... 399/92
7,005,030 B2 * 2/2006 Van Heeswijk et al. .... 156/277
2003/0042353 A1 * 3/2003 Savini et al. ..... 242/564.2

FOREIGN PATENT DOCUMENTS

EP 1291189 3/2003
EP 1391408 2/2004
JP 03003850 A * 1/1991

* cited by examiner

*Primary Examiner*—Daniel J. Colilla
*Assistant Examiner*—N. Ha
(74) *Attorney, Agent, or Firm*—Robert A. Sabourin

(57) ABSTRACT

A large format printer using web fed material is able to cope with roll fed material and sheets having residual curl. An anti-curl guidance device counteracts curl when feeding the medium to a second transport system. The medium is held flat by a vacuum system and during re-feeding of the medium, the height of the position of the medium exhibiting residual curl is adjusted by a moving pivot roller to smoothly pass over a cutting bar. Also, the entrance of a re-feeding chamber is enlarged by lifting a retractor pivot plate by a retractor pivot to allow curled media to enter the re-feeding chamber. Curl can also be avoided by keeping the web roll of media in a relatively humid condition by restricting air flow or by using an extra humidifier.

8 Claims, 9 Drawing Sheets

COLOUR PROOFER WITH CURL CONTROL MEANS

The application claims the benefit of U.S. Provisional Application No. 60/576,921 filed Jun. 4, 2004.

FIELD OF THE INVENTION

The present invention relates to a solution for feeding large size media having residual curl in a large size ink jet printer.

BACKGROUND OF THE INVENTION

In EP-A-1 291 189, herein incorporated by reference in its entirety for background information only, a double sided color proofing apparatus uses rolled web material as printing stock and is further provided with a web feed device, a tumbler unit for turning the receiving medium and a alignment sensing and correction system. The web feeding device is provided with a decurling roller to reduce curl of the medium when the paper is fed from the paper roll. However is was found that, even when using the decurling roller, not all curl can be removed leaving a problem of residual curl, even after decurling of the medium. Especially when making very large format printers residual curl can still pose severe problems and can lead to a misfeed of the cut sheet and paper jam during functioning of the printer.

Another problem is that curl is depending upon relative humidity of the paper stock. There have been reports of working environments having a relative humidity of 10% during weekend days when conditioning systems of the print room are switched off. As the working week is started conditioning systems are switched on but the paper roll can not be rehydrated in time to avoid functioning problems.

There is clearly a need for an improved printing apparatus capable of avoiding problems due to residual curl of the print medium. There is a need for printing apparatus capable of handling media having considerable curl. This would put less restrictions on the quality and conditioning of the paper.

SUMMARY OF THE INVENTION

A large format printer using web fed material is able to cope with roll fed material and sheets having residual curl. An anti-curl guidance device counteracts curl when feeding the medium to a second transport system. The medium is held flat by a vacuum system and during re-feeding of the medium, the height of the position of the medium exhibiting residual curl is adjusted by a moving pivot roller to smoothly pass over a cutting bar. Also, the entrance of a re-feeding chamber is enlarged by lifting a retractor pivot plate by a retractor pivot to allow curled media to enter the re-feeding chamber. Curl can also be avoided by keeping the web roll of media in a relatively humid condition by restricting air flow or by using an extra humidifier.

The problems noted above are overcome by the present invention as claimed and supported by the description and drawings herein.

DETAILED DESCRIPTION OF THE PREFERRED EMBODIMENTS

Ways to counteract the problems which can be caused by residual curl of the receiving sheet are described herein. Residual curl is curl remaining in the material fed to the printer, even after possible de-curling procedures which have the aim to remove or reduce curl in the printing material. The means for counteracting residual curl will be described as the functioning of a printing apparatus is explained. They do not reduce the curl properties of the material but allow the apparatus to handle curled media.

While the present invention will hereinafter be described in connection with preferred embodiments thereof, it will be understood that it is not intended to limit the invention to those embodiments.

Figure 1:
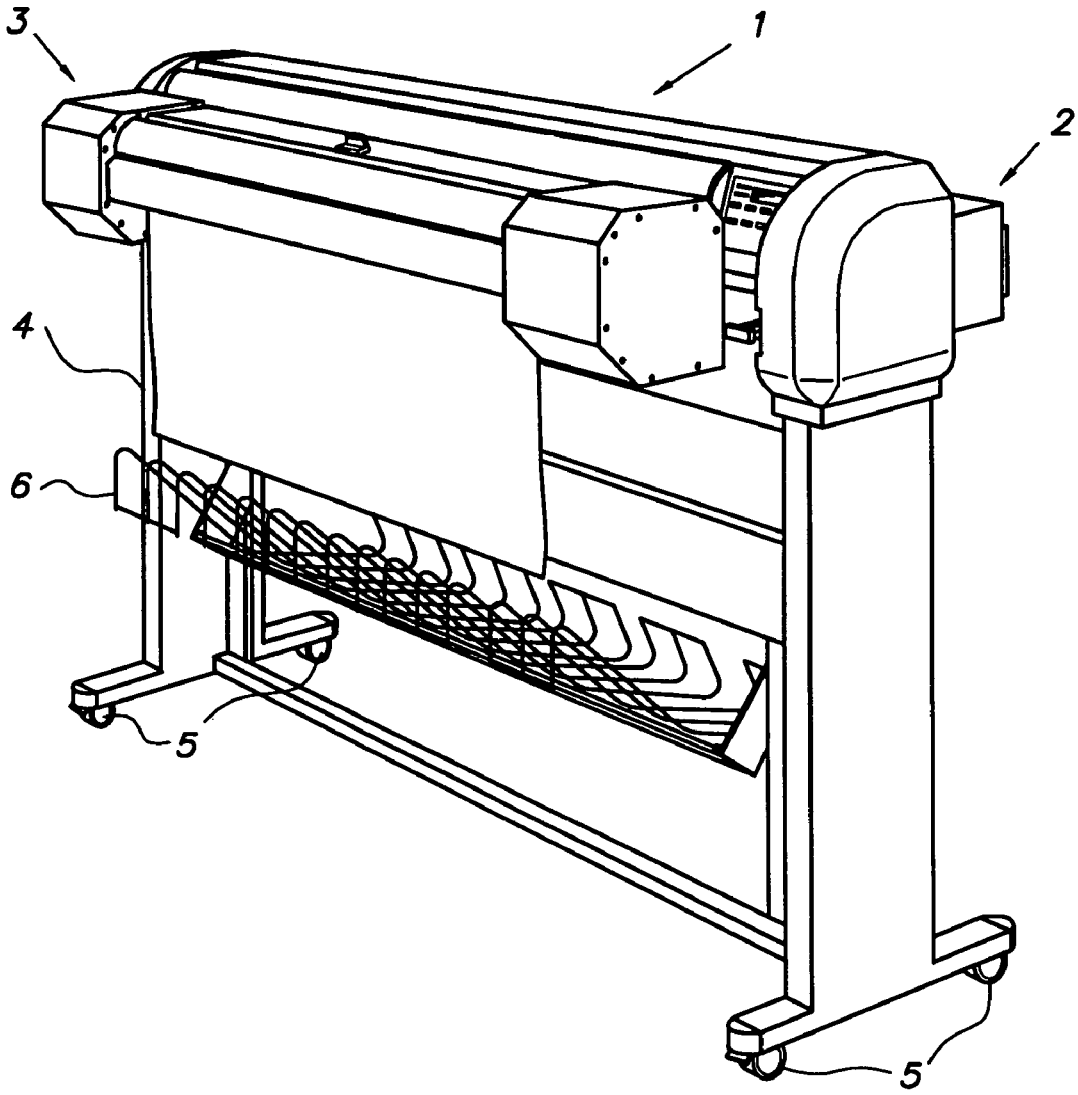
FIG. 1 shows an overall view of the printing apparatus.

In FIG. 1 a printing apparatus is shown for printing double sided images. The apparatus comprises several main parts:

- a print unit 1 having a printhead for printing an image on the receiving medium
- a medium supply means 2 for feeding said media to said print unit
- as the printing apparatus is designed for double sided printing a tumbler unit 3 is also present for turning the receiving medium after a first image is printed on the first side.

The printing apparatus is usually supported by a light-weight pedestal 4 which can be provided with wheels 5 making it easy to move the printing apparatus. On the pedestal 4 is mounted a receiving basket 6 to store finished prints.

A preferred embodiment is now described using a description of the operation steps during dual side printing.

Figure 2:
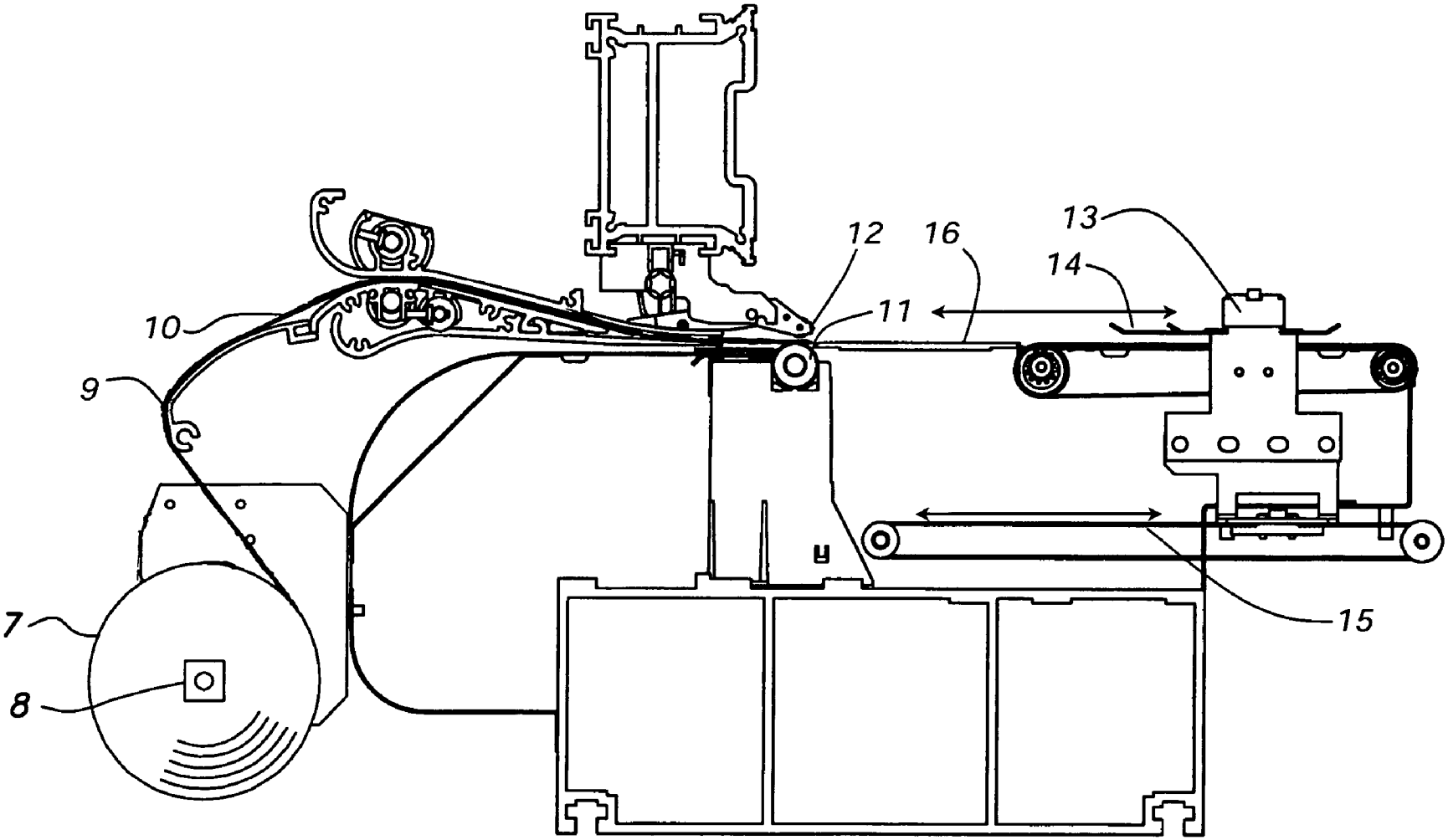
FIG. 2 gives a cross section of the web feed and printing unit and the anti-curl guidance FIG. 3 gives an isometric view of the print drive system, suction plate and anti-curl guidance mechanism.
Figure 3:
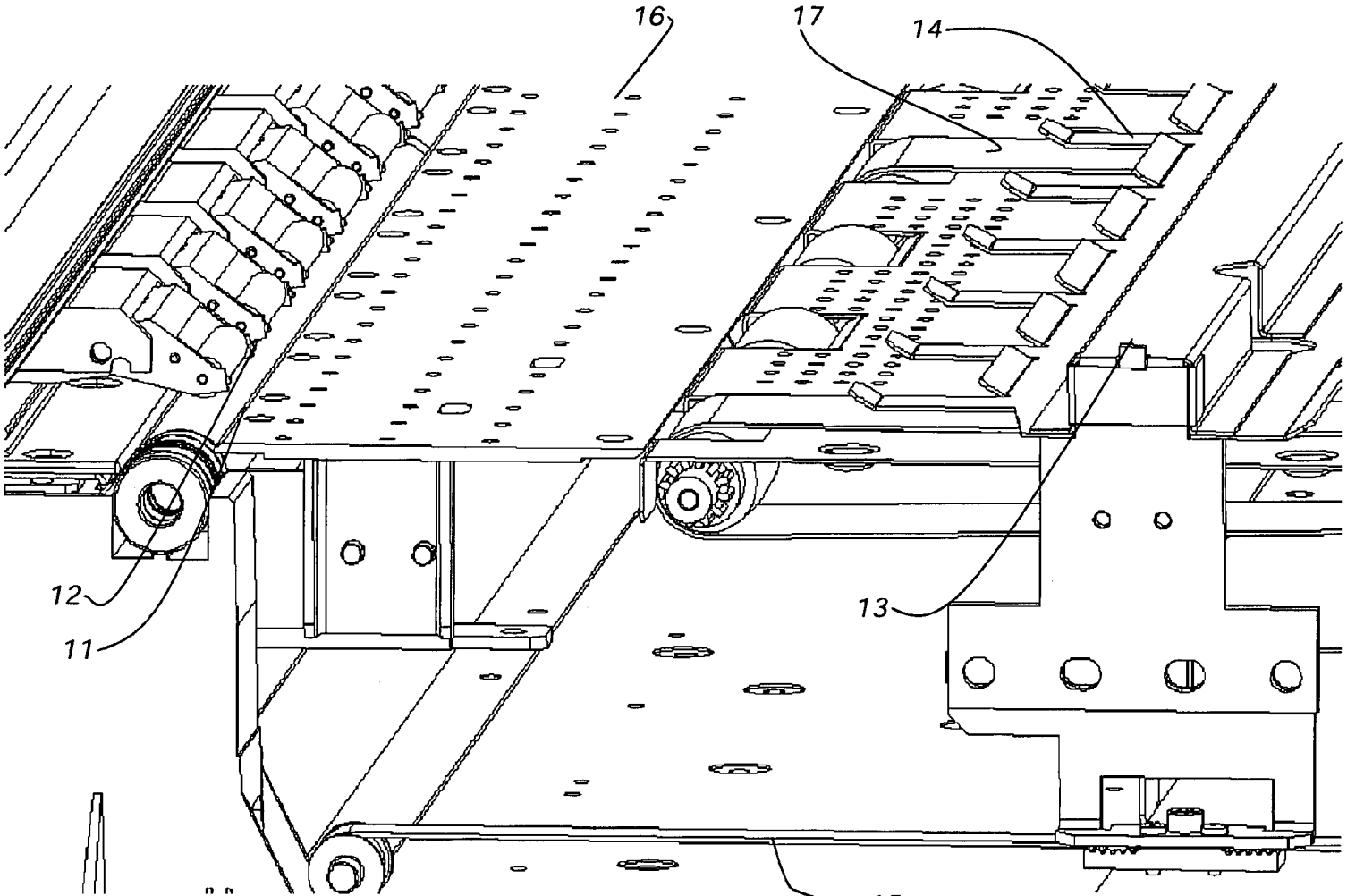

Reference is made to FIGS. 2 and 3.

The media supply means comprises:

- a media roll holder and medium roll 7 having a friction brake mechanism 8 causing torque and preventing spontaneous unwinding of the medium roll 7,
- a de-curling plate 9 for reducing curl induced in the receiving medium 10 by storage in a rolled up condition.

The print unit 1 itself is provided with printer drive rollers 11 and printer pinch rollers 12 which can be lowered onto the receiving medium 10 and which are provided for holding and transporting the receiving medium 10 at a constant speed during printing of the images. Preferably the rollers are provided along the complete width of the apparatus and the drive rollers 11 are driven by a single motor to ensure a constant and even transport of the receiving medium 10 without skew or other irregularities. A possible type of roller for the drive rollers 11 is a metal grid roller while the pinch roller(s) 12 usually have an elastomeric surface As the printer is designed for large size pages, up to 50 inch width, the middle section of the bar carrying the pinch rollers has relative less force for pinching the paper to the drive rollers. The bar carrying the inch rollers is made heavier using metal rollers or loads to enhance the pinching action of the pinch rollers in the middle and thus also enhancing the correctness of feeding of the paper.

Web Feeding Step

When operating from a new medium roll 7 the leading part of the receiver medium 10 has to loaded by hand into the print unit 1 where it is caught by lowering the lowered printer pinch rollers 12 which will ensure further transport.

During printing the receiving medium 10 is advanced. Due to the torque caused by the friction brake mechanism 8 acting upon the medium roll 7 a tension is created in the receiving medium 10 and curl which remained in the material due to the storage in rolled up state is substantially removed by guiding the material in a relative sharp bend over a guide plate 9.

As the web passes the drive and pinch roller 11, 12 location it is met by the anti-curl guidance 13.

Preferably the anti-curl guidance 13 comprises an array of rigid, metal fingers 14 holding the leading edge of the paper web down. A transport belt system 15 enables the anti-curl guidance to translate between a position close to the drive rollers of the print unit and the tumbler unit situated on the right side.

The translation orientation is indicated by the double arrow in FIG. 2.

The receiving medium 10 is also guided over a suction plate 16 further holding down the receiving medium 10 at the position of the print head also avoiding problems which can be caused by residual curl in the receiving medium 10. In the suction plate 16 suction holes are provided while one or more ventilators provide a vacuum in a compartment under the suction plate 16. The receiving medium 10 guided over the suction plate 16 is held to the suction plate 16 by the suction acting upon the receiving medium 10 through the suction holes in the plate. This ensures a constant distance from the print head to the receiving medium 10.

Figure 4:
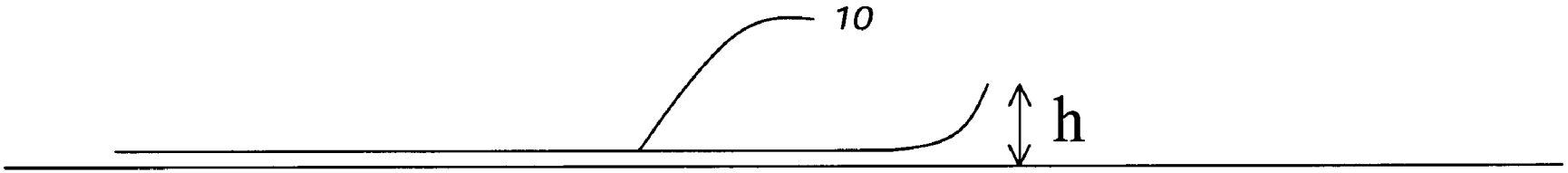
FIG. 4 explains a measurement system for □uantizing curl.

As illustrated in FIG. 4 the residual curl in web fed paper can be quantified by the height h of the edge of the paper sheet above e.g. a table when the sheet is put flat on a table. This can be as much as e.g. 5 cm above the table level, even higher values have been reported. With such a residual curl the paper web would certainly miss the transport rollers of the tumbler unit and a misfeed would be the result.

The aim of the anti-curl guidance 13 is to hold the paper edge down so it can be fed to the transport rollers of the tumbler unit downstream the printhead.

With the printhead put outside the paper path the anti-curl guidance is translated to the drive rollers 11 of the printing unit by the transport system 15. As the medium passes the drive and transport rollers 11, 12 it is fed further forward.

A sensor in the front plate detects the media and indicates when the anti-curl guidance 13 can translate back from the main unit towards the tumbler unit at substantially the same speed as the feeding of the paper.

Figure 5:
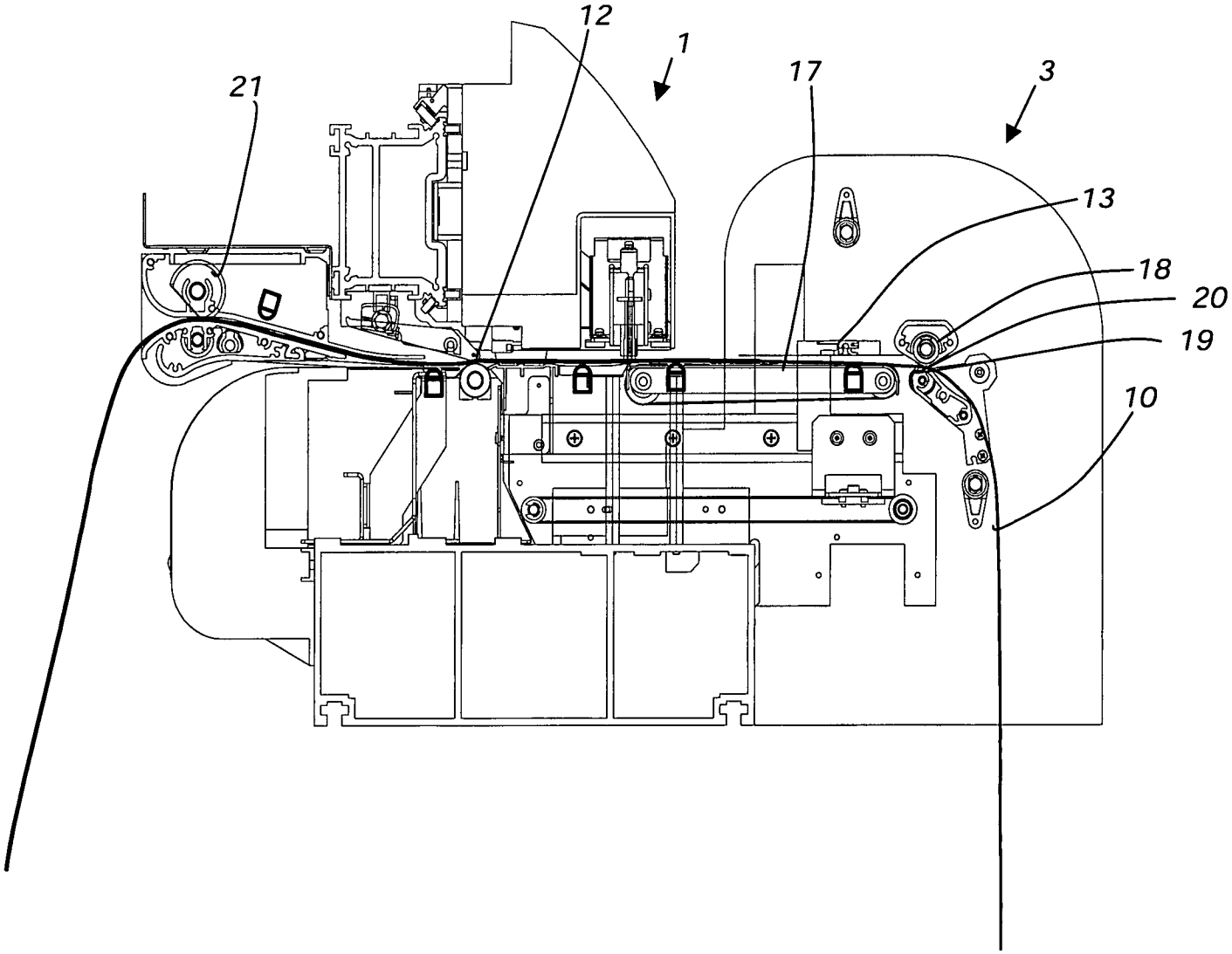
FIG. 5 gives a cross-section of the apparatus after printing of the image on the first side.

During the feeding of the paper the anti-curl guidance means holds down the edge of the sheet between the metal fingers 14 and the suction plate 16. The anticurl 13 guidance guides the edge of the sheet until the end position at the tumbler unit is reached. Then the sheet is further fed forward as is indicated in FIG. 5. However as soon as the anti-curl guidance passes the printhead position which is located above the suction plate printing can start.

Before printing is commenced, the leading edge and the size of the receiving medium 10 is detected using a sensor. Preferably this is done by one or more optical sensors using measurement of reflection or transmission. A single reflection sensor, mounted on the shuttle holding the print head, can be used for detecting the edges of the receiving medium 10, but separate systems using one or multiple sensors can be employed.

Out of these measurements the size of the receiving medium 10 can be detected and even misalignment can be indicated to the operator.

When the medium size is correct and no alignment errors are detected the front-side image is printed by the print head. In the described embodiment this is done by a colour inkjet print head mounted on a shuttle. As the print head shuttles across the receiving medium 10 the image of the front side is recorded on the receiver. In between the different swaths of the print head the receiving medium 10 is moved forward by the printer drive rollers 11 in a controlled manner.

In this way the image is printed gradually. Image data is supplied to the print unit 1 from an image source in a synchronised manner. When using the apparatus for colour/imposition proofing a image containing several pages of a publications are printed on the front side of the receiving medium 10.

As is indicated in FIG. 5, while the printer prints the front-side, the leading end of the receiving medium 10 gradually passes under the anti-curl guidance 13 and enters the tumbler unit 3 located on the front side of the print unit 1.

Further downstream, after the printhead a few extra transport belts 17 are provided to pull the paper further forward. Preferably these are vacuum transport belts having holes through which vacuum holds the transported paper. The speed of the transport belt is however a bit larger than the paper feed speed. This provides stretching of the paper so that curl is also counteracted in the center of the sheet and the distance to the printhead is kept at an ideal value.

As the paper is fed forward it passes underneath the anti-curl guidance 13 and it is fed between the transport rollers 18 and pinch rollers 19 of the tumbler unit 3.

Not shown in FIG. 5 is that the nip 20 between the front drive rollers 18 and corresponding front pinch rollers 19 is initially left wide open in order to freely let the leading end of the receiving medium 10 pass through the tumbler unit 3. This feature of the apparatus also counteracts problems when the medium has a certain residual curl. It ensures that the transport speed of the print unit 1 is not influenced and the printed image is undisturbed.

When the front-side image is completely printed the receiving medium is fed to the required position to enable it to be cut of at the correct place. The printer driver rollers 11 stop and hold the receiver medium 10.

The pinch rollers 19 in the tumbler unit now are lowered and pinch the receiving sheet between the tumbler driver rollers 18 and pinch rollers 19 as shown in FIG. 5. It has to be remarked that the transport and pinch rollers of the tumbler unit are preferably located outside of the image area in order not to damage the printed image.

After printing of the image the paper is held by the main transport rollers 11, suction plate and the transport rollers 18 of the tumbler unit.

A cutting mechanism now cuts the receiving medium 10 at the appropriate location separating the printed image from the non-printed part of the receiving medium 10 thus creating a receiver sheet carrying a printed image on the front-side.

Several possible cutting mechanisms can be used. Preferable the cutting can be done using a knife blade mechanism mounted on the shuttle of the print head which can be actuated when necessary. After the cutting the front drive/pinch rollers 18, 19 now have control over the receiver sheet, only holding the sheet at the side edges.

Web Retraction Step

As shown in FIG. 5, after the printed image is separated from the rest of the web the rear pinch roller 21 contacts the web. This can be done by a lowering mechanism, but as indicated in FIG. 5 an embodiment is possible wherein a partial roller contacts the web simply by rotation of the partial pinch roller 21. The dimensions of the rear pinch roller 21 may be so that it spans the whole width of the printer or it may be divided into two or more pinch rollers 21 dispersed over the printer width. Preferably the web has to be contacted at least two points relatively far apart to ensure that the web is prevented from rotating to a slant position.

After the rear pinch roller 21 contacts the web, the printer pinch rollers 12 are lifted so that the control of the web is given to the rear pinch roller 21 which prevents the receiving medium 10 from dropping out of the print unit 1.

Figure 6:
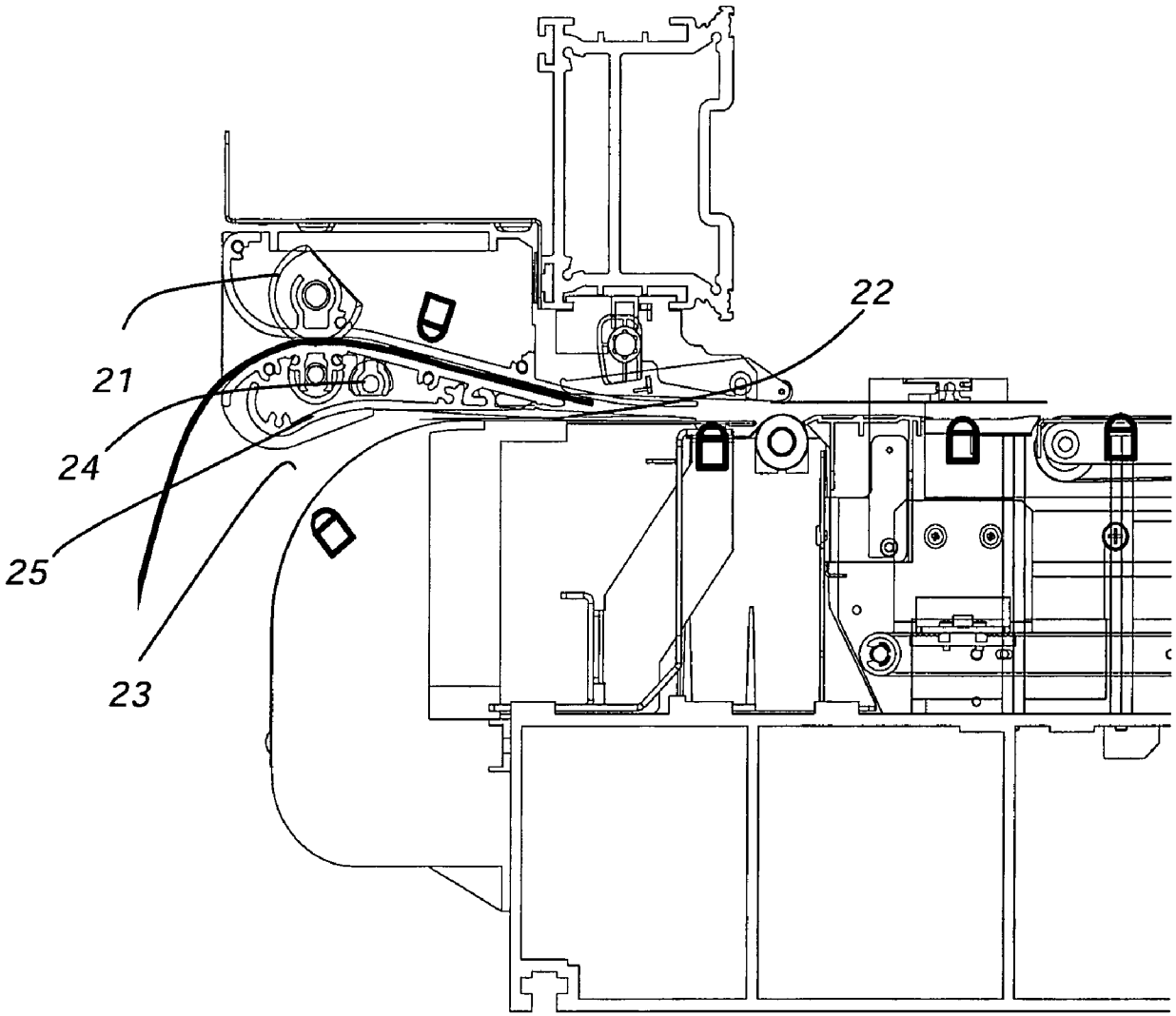
FIG. 6 illustrates the web retraction system and retractor pivot plate.

As shown in FIG. 6, by rotating the rear pinch roller 21 backwards the leading end of the web is retracted behind the position of the print head and the position of the printer pinch rollers 12. Retraction is stopped when the entrance slit 22 of the re-feeding storage chamber 23 is cleared. The leading end of the web is kept stationary until the printing of the next front-side image. Depending upon the dimensions of the printer and the rear pinch roller 21 itself, the number of rotations of the rear pinch roller 21 may vary. A small diameter of the roller 21 may require several rotations to retract the leading end of the web. In case of a partial roller, as shown in FIG. 6, the dimensions need to be chosen so that only a partial rotation is necessary to perform total retraction.

The retraction and holding of the receiving web by the rear pinch roller 21 during further printing of the backside image allows also to automatically load the receiving medium 10 to the printing unit.

The receiving sheet cut from the web, carrying the front side image, is fed forward into and through the tumbler unit 3 by rotation of the front-drive rollers 18, coupled to a drive disc, until the rear end of the receiving sheet has cleared the printer unit 1. The front end drive rollers 18 are stopped and tumbling action is started.

Now the receiving medium is turned upside down by the tumbler unit so that recording at the back side of the medium can be done.

The tumbler sequence essentially is a combination of

- changing the orientation of the nip 20 between the drive roller/pinch roller 18, 19 pairs by turning the mounting disk on which the axis of the rollers are mounted,
- feeding through the medium using the drive roller/pinch roller 18, 19 pairs so that the leading edge of the paper is fed back between the roller pairs.
- the orientation of the nip 20 is then changed again and the sheet is fed back into the printing unit.

Reloading of the Web

Figure 7:
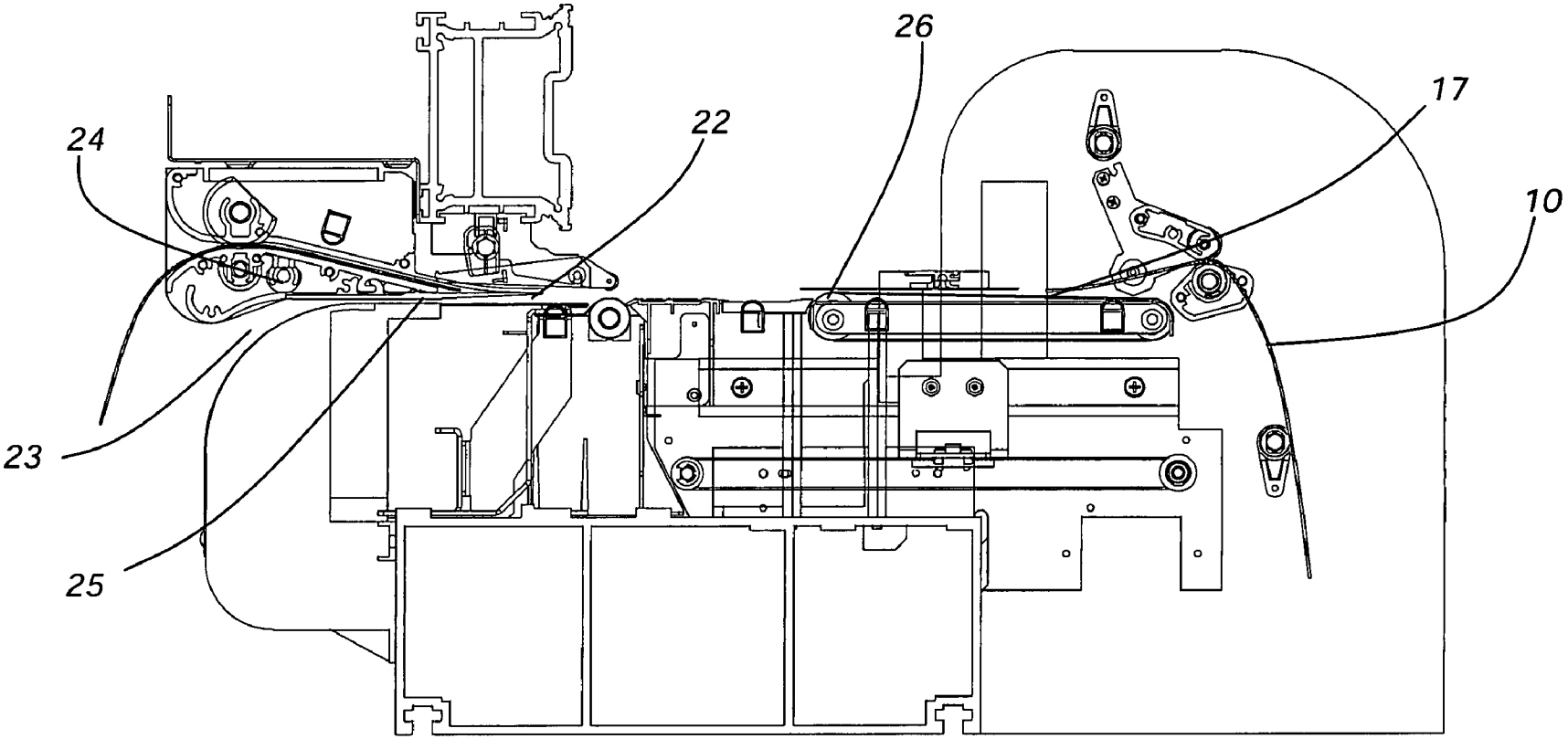
FIG. 7 gives a cross-section of the apparatus with a lifted retractor pivot plate FIG. 8 gives an isometric view of the retractor pivot and retractor pivot plate.

The reloading sequence is started from the situation of FIG. 7. The sheet is fed backwards into the printing unit 1 into a re-feeding chamber 23.

The re-feeding chamber 23 is located below the path from which the media is fed from the roll in the first printing sequence.

In order to facilitate the entrance of the cut sheet still having considerable residual curl into the re-feeding chamber the opening is enlarged. This is accomplished by a rotatable retractor pivot 24 lifting the retractor pivot plate 25. During feeding of the media from the roll the pivot plate 25 is in a lowered position so that the media can easily pass over it.

Figure 8:
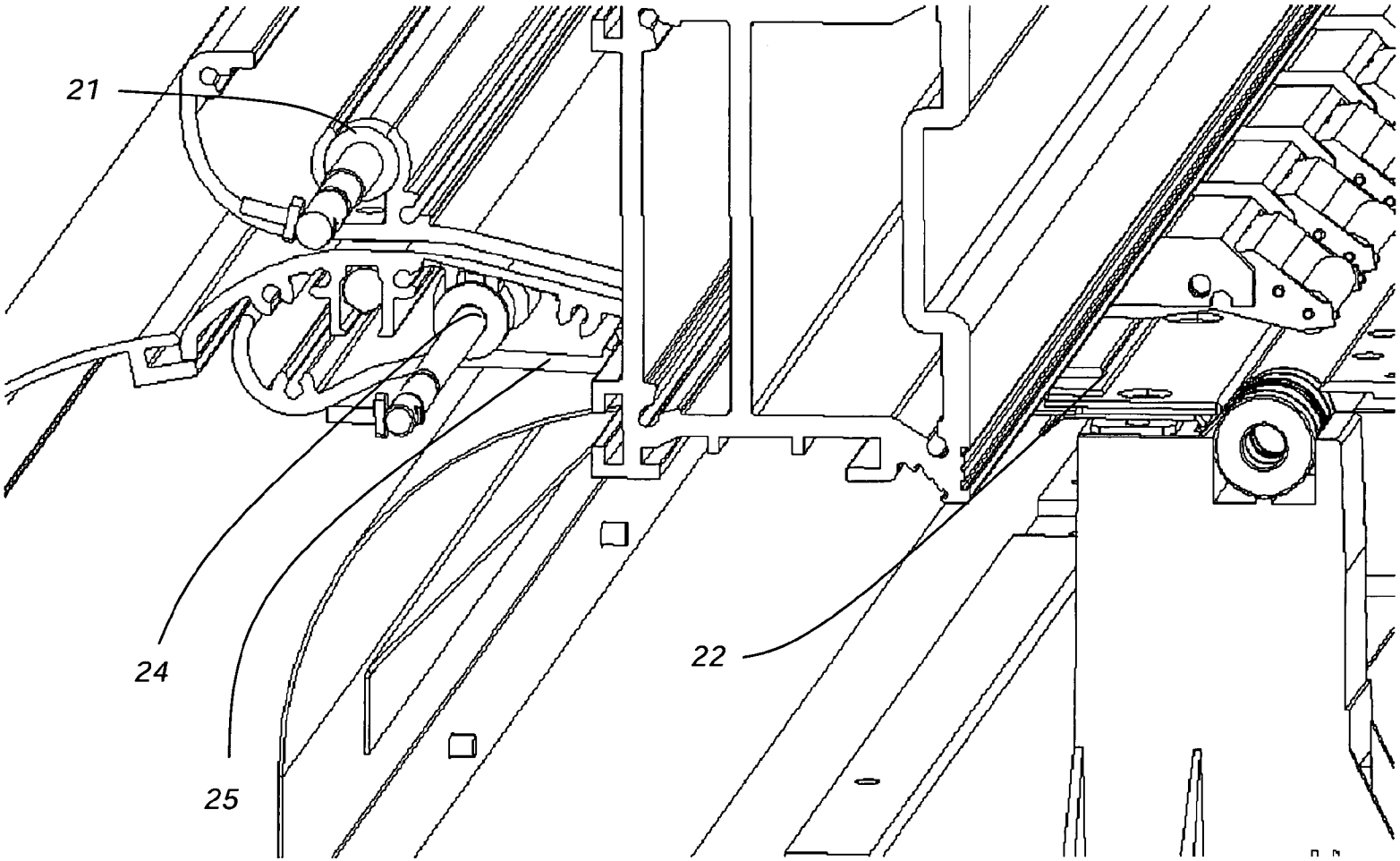
Figure 9B:
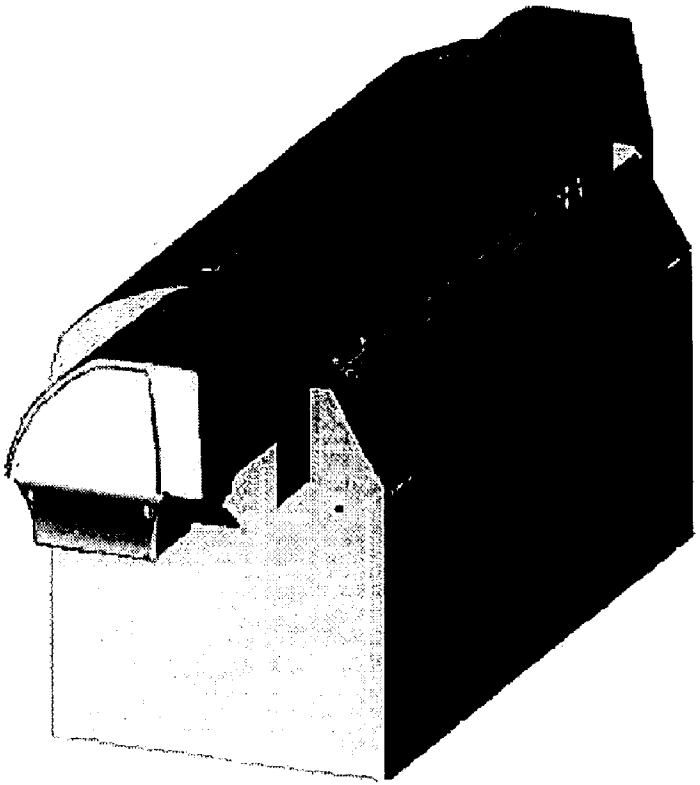
FIGS. 9A and 9B illustrate the use of shutters to enclose the media roll to restrict air flow.
Figure 9A:
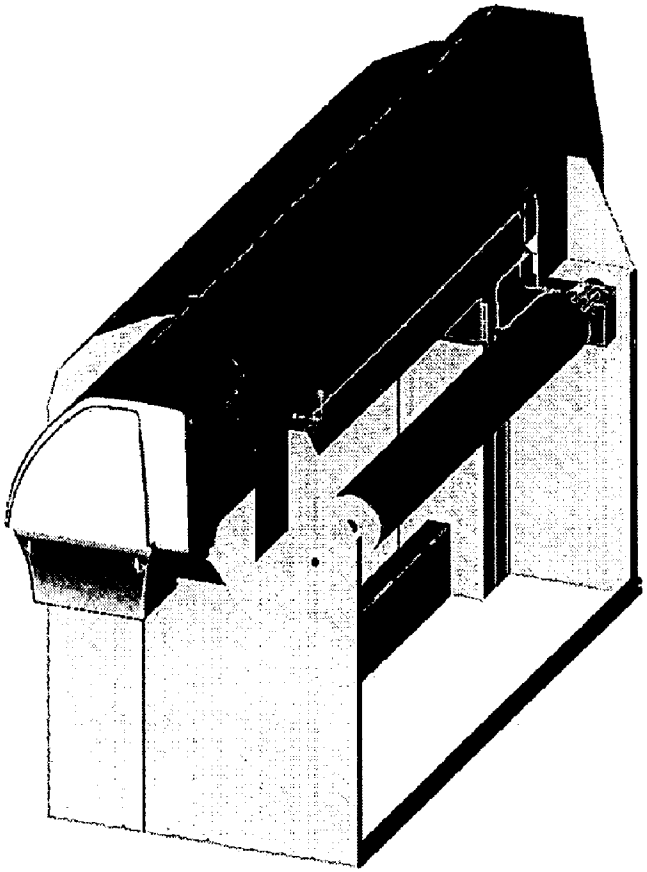

During the re-feeding step the retractor pivot plate 25 is moved upwards to enlarge the opening of the re-feeding chamber. This allows for the cut sheet having residual curl to easily enter the chamber 23 and counteracts any re-feeding problems using media with residual curl. This situation is illustrated in FIG. 7 and FIG. 8

Due to the size, it was not possible to re-feed the media with the 2 tumbler drive/pinch roller 18, 19 pairs outside the image area at the edges of the sheet. As indicated a few extra transport 17 belts are implemented in the front plate of the tumbler unit 3 to pull the large receiving media upward and feed it back into the printing unit.

Even a pivot roller 26 is added which can be moved up or down to adjust the height of the position of the transport belts during re-feeding of the guided media having curl to let is pass smoothly over the media cutting bar. By moving the pivot roller up the height of the transport belts is changed and the edge of the sheet, now having downwards curl is lifted over the cutting bar or other fixed apparatus parts and is directed to the entrance 22 of the re-feeding chamber 23. This feature of the apparatus counteracts problems which are normally expected to arise when using media having considerable residual curl.

Alignment of the re-fed sheet can be done using the edges of the media. After some experience it was detected that the first printed image is not always parallel to the edge of the media.

Preferably some marks are printed on the left and right side of the first image which are measured with the position sensors on the verso side the length of the image. After some calculation we can scale/adjust the second image on the verso side.

Once the sheet is located into the re-feeding chamber 23 the second printing cycle can begin.

After printing the verso side of the sheet, the sheet is fed through out of the printing apparatus into the receiving basket mounted on the pedestal 4 to store finished prints.

The leading edge of the roll media which is held by the rear pinch roller 21 of the retraction system can be fed forward again and a new recording cycle can start using the anti-curl guidance to guide the sheet.

Another aspect is that it is also possible to avoid the occurrence of excessive residual curl. A very important parameter is the relative humidity in which the roll media 7 is stored in the apparatus. A relative high humidity is preferred as paper then exhibits low residual curl.

Diverse conditions can cause the roll to become very dry leading to problems

A first possibility to avoid the drying of the roll is by enclosing the roll inside the apparatus to avoid air flow. This can be done using a special cover design restricting possible air flow.

A possible embodiment is shown in 9A and B.

At least the past storing the paper roll should be enclosed. Preferably the cover comprises shutters which can be easily opened and closed to facilitate the changing of the roll of paper.

An even better embodiment is one wherein the relative humidity is measured and problems can be reported to the operator of the printing apparatus. In very difficult conditions a system for regulating the relative humidity can be used to keep the roll at the correct relative humidity for printing.

Having described in detail preferred embodiments of the current invention, it will now be apparent to those skilled in the art that numerous modifications can be made therein without departing from the scope of the invention as defined in the appending claims.

The invention claimed is:

1. A printing apparatus comprises:

a print unit having a print head for printing an image onto a receiving medium;

medium supply means for feeding said receiving medium to said print unit;

a re-feeding storage chamber, having an entrance slit for re-feeding a printed page;

means for counteracting effects of residual curl of the receiving medium;

wherein said means for counteracting effects of residual curl includes a movable rear pivot plate for enlarging the entrance slit of the re-feeding storage chamber to avoid problems due to curl of a backend of the receiving medium.

2. The printing apparatus according to claim 1 wherein the means for counteracting effects of residual curl comprises guidance means for holding down a leading edge of the receiving medium and for translating substantially at a same speed as the receiving medium when the receiving medium is fed forward.

3. The printing apparatus according to claim 1 wherein the means for counteracting the effects of residual curl further comprises at least one transport belt for pulling the receiving medium forward.

4. The printing apparatus according to claim 3 wherein a speed of said transport belt during paper feed is higher than a speed of the receiving medium to enable stretching of the receiving medium to counteract residual curl of the receiving medium.

5. The printing apparatus according to claim 1 wherein the means for counteracting the effects of curl further comprises a pivot roller for changing a height of the transport belts to lift an edge of the receiving medium over fixed apparatus parts during re-feeding of the receiving medium toward the re-feeding chamber.

6. The printing apparatus according to claim 1 further comprising a system for keeping a receiving medium roll in an atmosphere with a regulated relative humidity to avoid occurrence of curl.

7. The printing apparatus according to claim 6 wherein said system comprises an envelope enclosing a frame containing the receiving medium roll for retaining the conditioned atmosphere.

8. The printing apparatus according to claim 7 wherein the envelope is provided by using shutters to allow easy access to the receiving medium roll.

* * * * *